US012006008B2

(12) United States Patent
Krüger et al.

(10) Patent No.: US 12,006,008 B2
(45) Date of Patent: Jun. 11, 2024

(54) DIVING APPARATUS AND DIVING SYSTEM

(71) Applicant: Dräger Safety AG & Co. KGaA, Lübeck (DE)

(72) Inventors: Lorenz Krüger, Lübeck (DE); Christopher Kuschel, Lübeck (DE); Carl-Christoffer Neumann, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 92 days.

(21) Appl. No.: 17/349,582

(22) Filed: Jun. 16, 2021

(65) Prior Publication Data

US 2021/0394878 A1 Dec. 23, 2021

(30) Foreign Application Priority Data

Jun. 19, 2020 (DE) ..... 10 2020 116 208.1

(51) Int. Cl.

| | |
|---|---|
| ***B63C 11/08*** | (2006.01) |
| ***B63C 11/02*** | (2006.01) |
| ***B63C 11/18*** | (2006.01) |
| ***B63C 11/22*** | (2006.01) |

(52) U.S. Cl.

CPC ..... *B63C 11/22* (2013.01); *B63C 11/08* (2013.01); *B63C 11/186* (2013.01); *B63C 11/2245* (2013.01); *B63C 2011/085* (2013.01)

(58) Field of Classification Search

CPC ..... B63C 11/02; B63C 11/08; B63C 11/2245; B63C 2011/085

USPC ..... 405/186

See application file for complete search history.

(56) References Cited

U.S. PATENT DOCUMENTS 3,536,071 A * 10/1970 Ferrando ..... B63C 9/1255 441/118
3,747,139 A * 7/1973 Braly ..... B63C 11/30 405/186
3,877,098 A * 4/1975 Braly ..... B63C 11/2245 128/202.14

(Continued)

FOREIGN PATENT DOCUMENTS

CN 109229308 A 1/2019
EP 1637446 A2 3/2006

(Continued)

*Primary Examiner* — Frederick L Lagman
(74) *Attorney, Agent, or Firm* — McGlew and Tuttle, P.C.

(57) ABSTRACT

A diving apparatus (10) supplies breathing air (L) and includes a basic body (12), a tank interface (20), a pressure reducer (22), a mouthpiece interface (24), and a display device (30). The tank interface connects to a breathing air tank (90) for the inlet of breathing air into the diving apparatus. The mouthpiece interface is configured for connection of a mouthpiece (92) for the supply of breathing air from the diving apparatus. The pressure reducer is arranged in a gas path of the diving apparatus between the tank interface and the mouthpiece interface for reducing gas pressure. The display device includes a display instrument (32) and a display line (34). A holding element (40) is configured to detachable fasten the display line at the basic body. A diving system (100) is provided including the diving apparatus (10), a breathing air tank (90) and/or with a mouthpiece (92).

21 Claims, 3 Drawing Sheets

(56) References Cited

U.S. PATENT DOCUMENTS 3,964,266 A * 6/1976 Bartlett ..... B63C 11/30 114/333
4,000,534 A * 1/1977 Cerniway ..... B63C 9/1255 405/186
4,016,616 A * 4/1977 Walters ..... B63C 11/46 114/315
4,114,389 A * 9/1978 Bohmrich ..... B63C 11/2245 441/96
4,681,552 A * 7/1987 Courtney ..... B63C 11/2245 441/115
4,779,554 A * 10/1988 Courtney ..... B63C 9/1255 441/116
4,810,134 A * 3/1989 Eaulconer ..... B63C 11/08 441/118
4,812,083 A * 3/1989 Mosier ..... B63C 11/2245 405/185
5,887,585 A * 3/1999 Dusenbery ..... A62B 25/00 128/201.27
6,478,510 B1 * 11/2002 Young ..... B63C 11/08 441/106
6,527,479 B1 * 3/2003 Courtney ..... B63C 11/30 405/185
6,923,177 B2 * 8/2005 Hart ..... B63C 11/2245 128/201.27
7,083,361 B2 * 8/2006 De Felice ..... B63C 11/2245 405/187
7,854,568 B2 * 12/2010 Ekuan ..... B63C 11/04 405/187
2003/0168061 A1 9/2003 Hart
2006/0054167 A1 * 3/2006 Garofalo ..... B63C 11/02 128/201.27
2008/0267715 A1 * 10/2008 Sullivan ..... B63C 11/2245 137/505.11
2010/0003083 A1 1/2010 Ekuan et al.

FOREIGN PATENT DOCUMENTS

GB 426962 A 4/1935
NO 20044074 9/2004
WO WO-8602613 A1 * 5/1986
WO 2007099771 A1 9/2007

* cited by examiner

DIVING APPARATUS AND DIVING SYSTEM

CROSS REFERENCE TO RELATED APPLICATIONS

This application claims the benefit of priority under 35 U.S.C. § 119 of German Application 10 2020 116 208.1, filed Jun. 19, 2020, the entire contents of which are incorporated herein by reference.

TECHNICAL FIELD

The present invention pertains to a diving apparatus. The present invention pertains, furthermore, to a diving system with such a diving apparatus.

TECHNICAL BACKGROUND

Diving apparatuses have been used for many years for military and/or professional usages as well as in recreational sports for the supply of breathing air to the user of the diving apparatus. Compressed air cylinders with open breathing circuits usually arranged on the back of the diver are used in recreational sports. Other diving apparatuses are predominantly worn in a front position, i.e., on the chest of the diver. For such diving apparatuses for the front position on a diver, it is advantageous if these diving apparatuses are additionally for diving using a back-carrying method.

The prior-art diving apparatuses have, in addition to the lines for the breathing circuit, additional lines for the connection of display devices, for example, a manometer for the fill level display of the compressed air cylinders. The hose length of the manometer in prior-art apparatuses is configured either for the back-carrying method or chest-carrying method. In case of an apparatus manufactured for the chest-carrying method, the hose, for example, between the manometer and pressure reducer or compressed air cylinder, is too short to guarantee the readability using the back-carrying method. Vice versa, in the case of an apparatus manufactured for the back-carrying method, the hose for the chest-carrying method is too long, which may lead to hazardous situations when diving, if the hose becomes entangled. When the apparatus is used for diving in the back position, it is not possible for the diver to check the display, especially the cylinder pressure, due to the short hose, especially the manometer hose, without taking off the apparatus. In prior-art apparatuses, the hoses for adapting to the back-carrying method or to the chest-carrying method are consequently replaceable components of the diving apparatus and are thus prone to damages, loss and/or wear. The replacement and/or the adaptation are, furthermore, usually possible with effort and only under predefined conditions for, for example, the oxygen purity.

SUMMARY

Based on this state of the art, the underlying object of the present invention is to provide a diving apparatus, especially a closed-circuit respirator, for the supply of breathing air and/or mixed gases as well as a diving system, which do not have these drawbacks or do not have them at least to some extent. The object of the present invention is especially to provide a diving apparatus as well as a diving system, which improve an adaptation of the diving apparatus for a chest-carrying method and/or a back-carrying method in a simple and cost-effective manner and thereby guarantee a safer operation of the diving apparatus. Both open diving apparatuses and closed-circuit respirators, in particular for the supply of breathing air and/or mixed gases, are taken into consideration within the framework of the present invention.

The above objects are accomplished by the diving apparatus of the present invention. Accordingly, the object is accomplished by a diving apparatus, especially a closed-circuit respirator, for the supply of breathing air having the features of the invention. In this case, features and details, which are described in connection with the diving apparatus according to the present invention also apply, of course, in connection with the diving system according to the present invention and vice versa, so that reference is made and can always be made mutually to the individual aspects of the present invention with regard to the disclosure.

According to a first aspect of the present invention the object is accomplished by a diving apparatus, especially closed-circuit respirator, for the supply of breathing air. The diving apparatus has a basic body, at least one tank interface, a pressure reducer, a mouthpiece interface, and a display device, wherein the tank interface is configured for connection to at least one breathing air tank for the inlet of breathing air from the breathing air tank into the diving apparatus and the mouthpiece interface is configured for connection of a mouthpiece for the supply of breathing air from the diving apparatus, wherein the pressure reducer is arranged in a gas path of the diving apparatus between the tank interface and the mouthpiece interface for reducing a gas pressure of the breathing air, and the display device comprising at least one display instrument and at least one display line, characterized in that the diving apparatus comprises at least one holding element, wherein the at least one holding element is configured for the detachable fastening of the display line at the basic body.

A mouthpiece interface may preferably have a supply line and a discharge line for a closed-circuit respirator. The at least one tank interface is preferably configured to be connected to a compressed air cylinder, a mixed gas cylinder and/or an oxygen cylinder, in order to supply the contents of the cylinder and/or cylinders to the diving apparatus and continuing to the user of the diving apparatus. Mixed gases are preferably configured as a mixture of pure oxygen and carbon dioxide within the framework of the application. Breathing air may comprise pure oxygen and optional portions of other gases. The diving apparatus according to the present invention preferably has a variety of holding elements, especially precisely three holding elements. A gas path according to the present invention is defined as the at least one path of the gas and/or gases through the diving apparatus. For example, the breathing air is supplied from one or more cylinders and is admitted into the diving apparatus via the tank interface. The tank interface is connected to the mouthpiece interface in a fluid-communicating manner. A pressure reducer is preferably arranged between the mouthpiece interface and the tank interface in order to reduce the gas pressure from a high gas pressure level at the tank interface to a lower gas pressure level at the mouthpiece interface. The display device may be connected, for example, to the pressure reducer and be configured such that the display device determines and displays the fill level of the at least one gas cylinder above the high gas pressure level, i.e., before the pressure reduction. The basic body of the diving apparatus according to the present invention may be configured as a housing and/or as a basic structure for providing a structural body and/or a shell for the diving apparatus. The at least one display line of the display device is according to the present invention a flexible line and/or a flexible hose, which connects the at least one display instrument to the diving apparatus, and especially to the pressure reducer. The at least one display instrument preferably comprises at least one display and at least one interface for the connection to the at least one display line.

The diving apparatus may, moreover, comprise at least one artificial lung, at least one overpressure valve for the at least one artificial lung, at least one soda lime container and/or at least one pneumatic system for switching over the modes of the diving apparatus, especially the modes for the supply of different gas mixtures, especially wherein the at least one soda lime container is sealed against the entry of fluids. The diving apparatus may further have at least one carrying interface for connection and/or integration of a carrying system. The basic body may be sealed at least to some extent and/or be floatable at least to some extent.

A diving apparatus according to the present invention is especially advantageous because of the at least one holding element, since the at least one holding element is configured for the detachable fastening of the display line at the basic body. The detachable fastening of the display line at the at least one holding element of the basic body makes possible an adaptation of the diving apparatus for a chest-carrying method or for a back-carrying method in a simple as well as cost-effective manner and thereby guarantees a safer operation of the diving apparatus. Adaptation of the arrangement and/or guiding of the at least one display line is especially made possible for an adaptation of the diving apparatus for a chest-carrying method or for a back-carrying method by means of the at least one holding element.

According to a preferred variant of the present invention, provisions may be made in a diving apparatus for the basic body to have an outer side and an inner side, wherein the at least one holding element is arranged on the inner side of the basic body. The basic body may, as described above, be configured, for example, as a housing, especially as a structurally reinforced housing. A basic body with an inner side and with an outer side advantageously provides protection as well as delimitation for the components and systems of the diving apparatus which are arranged on the inner side of the basic body. The basic body may preferably have an at least two-part configuration, for example, comprised of a body and a cover and/or two halves. The at least one holding element is preferably arranged on the inner side of the basic body, and especially on the inner side of a housing cover. A diving apparatus configured in this way is especially advantageous since an adaptation of the diving apparatus for a chest-carrying method or for a back-carrying method is made possible in a simple as well as cost-effective manner and thereby a safer operation of the diving apparatus is guaranteed. An arrangement of the at least one holding element on the inner side of the basic body, especially on the inner side of a housing cover is especially advantageous for a weight distribution and/or use of installation space of the diving apparatus.

According to a preferred variant of the present invention, provisions may be made in a diving apparatus for the basic body to comprise at least one opening for guiding through the display line from the inner side to the outer side, especially wherein the display instrument is arranged on the outer side. A guiding through of the display line from the inner side to the outer side, especially with an arrangement of the display instrument on the outer side, is especially advantageous since a diving apparatus configured in this way makes possible a protective arrangement of the at least one holding element in the interior of the basic body and an advantageous arrangement of the display instrument for advantageous reading of the display instrument on the outer side of the basic body. The guiding through usually does not need any sealing, since a targeted flooding of the inner side in at least some areas is desired in a diving apparatus according to the present invention to avoid an air bubble on the inner side, to avoid an unwanted buoyancy as a consequence thereof in the use of the diving apparatus as well as to avoid a pressure gradient from the inner side to the outer side of the basic body.

According to a preferred variant of the present invention, provisions may be made in a diving apparatus for the diving apparatus to have a stowing bracket for the stowing, detachable fastening of the at least one display instrument at the basic body, especially on the outer side of the basic body. The stowing bracket shall be distinguished especially in a technically functional manner from the at least one holding element. Contrary to the at least one holding element, the stowing bracket is used for stowing the at least one display instrument at the basic body, whereas the at least one holding element is configured for the detachable fastening of the at least one display line at the basic body. The at least one display instrument is usually arranged at a free end of the display line and is usually connected to the display line. The at least one stowing bracket is used for the secure positioning and stowing of the display instrument to avoid or at least to reduce damage, unwanted freedom of movement of the least one display instrument and/or an entanglement of the display device. When the diver does not need the display device, especially the display instrument, the display instrument can be stowed in the stowing bracket and thus advantageously has a defined position for the next use of the display instrument for the diver. In particular, the at least one stowing bracket is arranged on the outer side of the basic body in order to guarantee an easy accessibility for a diver. Contrary to the detachable fastening of the display line in the at least one holding element, a stowing of the display instrument in the stowing bracket is especially possible during a dive, especially without an opening of the basic body of the diving apparatus.

According to a preferred variant of the present invention, provisions may be made in a diving apparatus for the at least one holding element to be configured for the tool-free fastening and removal of the display line at the basic body. The at least one holding element may be configured as a snap holder, patch plug or plug in connection, clip and/or as another holding element for the tool-free fastening and removal of the display line at the basic body. In addition or as an alternative, especially the diving apparatus, especially an opening of the basic body of the diving apparatus, is configured for the tool-free fastening and removal of the display line. The tool-free fastening and removal of the display line at the basic body of the diving apparatus represents an especially advantageous configuration of the present invention, since an adaptation of the diving apparatus for a chest-carrying method or a back-carrying method is thus guaranteed in a simple as well as cost-effective manner and thereby a safer operation of the diving apparatus is made possible. In particular, an adaptation of the arrangement and/or guiding of the at least one display line is made possible for an adaptation of the diving apparatus for a chest-carrying method or for a back-carrying method in a tool-free manner by means of the at least one holding element for the tool-free fastening and removal of the display line at the basic body.

According to a preferred variant of the present invention, provisions may be made in a diving apparatus for the diving apparatus to comprise at least two holding elements, especially at least three, preferably precisely three holding elements, wherein the at least two holding elements are arranged at a spaced location and/or at an angle, especially 90° or essentially 90°, to one another. The phrase "X or essentially X" shall be defined within the framework of the present invention as a possible, slight deviation, for example, because of production tolerances and/or material properties, without changing the underlying, intended function of the feature. The orientation of the at least two holding elements to one another is referred within the framework of the present invention in relation to the guiding, holding and/or fastening of the display line in the at least two holding elements. An arrangement at an angle, especially 90° or essentially 90°, of the at least two holding elements to one another means consequently that the sections of the display line in the at least two holding elements have an arrangement at an angle, especially 90° or essentially 90°, to one another. The further configuration of the at least two holding elements and/or the fastening of the at least two holding elements at the basic body of the diving apparatus, is not relevant for the described orientation of the at least two holding elements to one another. A diving apparatus configured in this way is especially advantageous since the at least two holding elements guarantee an adaptation of the diving apparatus for a chest-carrying method or for a back-carrying method in a simple as well as cost-effective manner and thereby a safer operation of the diving apparatus is made possible. In particular, an adaptation of the arrangement and/or guiding of the at least one display line for an adaptation of the diving apparatus for a chest-carrying method or for a back-carrying method is made possible due to the arrangement of the at least two holding elements to one another.

According to a preferred variant of the present invention, provisions may be made in a diving apparatus for the at least one display line to be configured as a pressure measuring line and/or the at least one display instrument is configured as a manometer, especially a finimeter. As concrete configurations for a diving apparatus according to the present invention, a pressure measuring line is an advantageous configuration for the display line and a manometer, especially a finimeter, is an advantageous configuration for the display instrument. As an alternative or in addition, the display instrument may comprise a depth gauge, a drag indicator of the depth measurement, a compass and/or a diving computer.

According to a preferred variant of the present invention, provisions may be made in a diving apparatus for the display line to have a free section and optionally a fastened section, wherein the fastened section can be produced from a part of the free section by the detachable fastening of the display line at the holding element, especially wherein the at least one holding element is arranged at the basic body such that the length of the free section can be shortened and the fastened section can be produced and/or can be lengthened by the detachable fastening of the display line at the holding element. A free section of the display line is especially defined within the framework of the present invention such that this free section of the display line is not guided and/or fastened, especially permanently guided and/or fastened, between two points, especially fixed-position points. Permanent guiding and/or fastening shall at the same time not be defined as a temporary stowing of the display instrument in the stowing bracket, but rather the detachable fastening of the display line in the at least one holding element, for example, for the duration of a dive or for the duration until the adaptation of the diving apparatus for a chest-carrying method or a back-carrying method. A fixed section of the display line is therefore guided and/or fastened, especially permanently guided and/or fastened, between two points, especially fixed-position points. In the diving apparatus according to the present invention, the fastened section is produced and/or lengthened due to the detachable fastening of the display line at the at least one holding element. Conversely, the free section of the display line is lengthened due to a severing of the detachable fastening of the display line from the at least one holding element in the diving apparatus according to the present invention. The free section is preferably arranged adjoining the at least one display instrument and the fastened section is arranged at the pressure reducer and/or at the basic body, especially in the basic body configured as a housing. The free section preferably has, with the display instrument, a free end, which can advantageously be stowed with the stowing bracket described above. A diving apparatus configured in this way is especially advantageous since the at least one holding element guarantees an adaptation of the diving apparatus, especially of the free section and of the fastened section for a chest-carrying method or for a back-carrying method in a simple as well as cost-effective manner and thereby a safer operation of the diving apparatus is made possible.

According to a preferred variant of the present invention, provisions may be made in a diving apparatus for the diving apparatus to have at least two holding element mounts, wherein the at least one holding element can be detachably fastened to each of the at least two holding element mounts. A holding element mount is defined within the framework of the present invention as a counterpiece to the at least one holding element. Thus, for example, a holding element can be plugged, clipped, rotated and/or arranged otherwise and/or detachably fastened into/in one of the holding element mounts. With at least two holding element mounts, the diving apparatus makes possible an advantageous flexibility and thus an adaptation of the diving apparatus to, for example, a chest-carrying method or a back-carrying method. In particular, the holding element mounts additionally make possible a fine adjustment of the diving apparatus to, for example, the height of the diver and/or an adaptation of the display device to the height of the diver. The at least one holding element can for this purpose be plugged or arranged otherwise and/or fastened into/in one of the at least two holding element mounts. The holding element mount may additionally make possible a freedom of movement for the at least one holding element, so that the at least one holding element is arranged in a rotatable and/or displaceable manner and/or fastened in the holding element mount.

According to a preferred variant of the present invention, provisions may be made in a diving apparatus for the display line to be able to be oriented by the at least one holding element at least in a first defined arrangement or in a second defined arrangement, especially on the inner side of the basic body. The display line may especially additionally be oriented in a third defined arrangement by the at least two holding elements. In this connection, the arrangement without a fastening of the display line in the at least one holding element represents the simplest arrangement of the display line. The different arrangements of the display line are optimized, for example, for the different carrying methods of the diving apparatus, the chest-carrying method and/or back-carrying method, so that the optimal length of the display line and the optimal distance between the diving apparatus and the display instrument for the different carrying methods of the diving apparatus are made possible by the different arrangements of the display line, especially on the inner side of the basic body. A diving apparatus configured in this manner is especially advantageous since the at least one holding element guarantees in a simple as well as cost-effective manner an adaptation of the diving apparatus, especially with a first defined arrangement or in a second defined arrangement of the display line, for a chest-carrying method or for a back-carrying method and thereby a safer operation of the diving apparatus is made possible.

According to a preferred variant of the present invention, provisions may be made in a diving apparatus for the display line to comprise at least one counter-holding element, wherein the at least one counter-holding element is configured for the detachable fastening with the at least one holding element. A counter-holding element may be configured, for example, as a clamp, a clip, a sheath, a hollow cylinder and/or another counter-holding element on the display line. The counter-holding element, or, for example, the clamp, preferably has a coupling interface for coupling with the at least one holding element. The counter-holding element is preferably arranged in a displaceable or stationary manner on, around and/or at the display line. The at least one counter-holding element thus advantageously makes possible a guiding of the display line instead of or in addition to a fixed fastening of the display line at the at least one holding element.

According to a preferred variant of the present invention, provisions may be made in a diving apparatus for the basic body to have at least one guide element, especially at least one raised section and/or one recess, for guiding the display line. The basic body may have, for example, a guide groove for the guiding and/or fastening of the display line at the basic body. The at least one guide element may preferably have a monolithic configuration with the basic body, especially with a basic body configured as a housing. For example, the basic body may be configured as an injection-molded component and/or as a fiber-reinforced composite and monolithically have a channel, and especially an open channel, and/or a groove for the mounting, guiding and/or fastening of the display line. A diving apparatus configured in this manner is especially advantageous since the at least one guide element guarantees in a simple as well as cost-effective manner an adaptation of the diving apparatus for a chest-carrying method or back-carrying method and thereby a safer operation of the diving apparatus is made possible.

According to a second aspect of the present invention, the object is accomplished by a diving system. The diving system has a breathing air tank and/or a mouthpiece, wherein the diving apparatus is configured according to the first aspect. The diving system may further comprise at least one artificial lung, at least one overpressure valve for the at least one artificial lung, at least one soda lime container and/or at least one pneumatic system for switching over the modes of the diving apparatus, especially the modes for the supply of different gas mixtures, especially wherein the at least one soda lime container is sealed against the entry of fluids. The diving apparatus may further have at least one carrying interface for connection and/or integration of a carrying system. The diving system according to the present invention has the same advantages as already described above in relation to diving apparatus according to the present invention. Accordingly, an adaptation of the diving system for a chest-carrying method or for a back-carrying method is guaranteed in the diving system according to the present invention using simple means as well as in a cost-effective manner and thereby a safer operation of the diving apparatus is made possible.

Additional measures improving the present invention appear from the following description about a few exemplary embodiments of the present invention, which are shown in the figures. All features and/or advantages appearing from the claims, from the description or from the drawings, including structural details and arrangements in space, may be essential to the invention both by themselves and in the various combinations. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
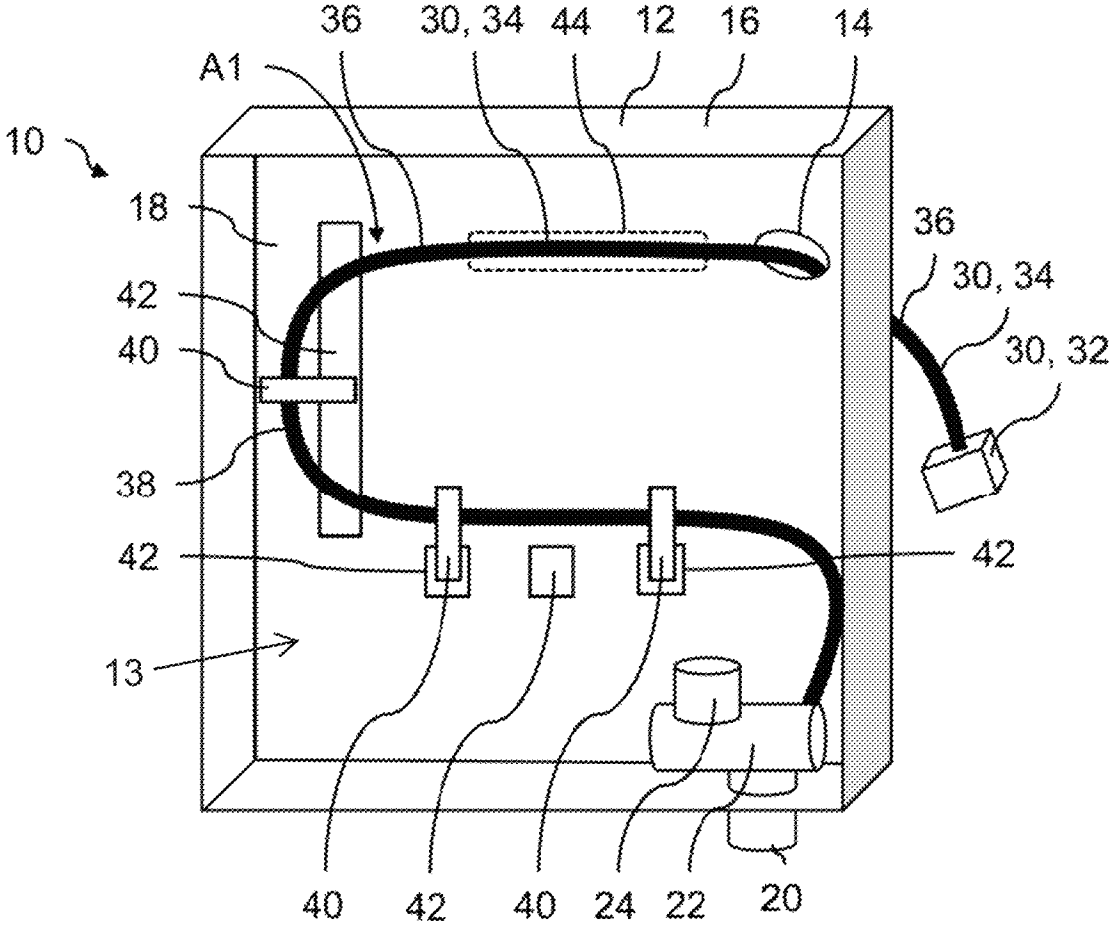
FIG. 1 is a schematic perspective view showing an inner side of a basic body of a diving apparatus with three holding elements and with a display line in a first arrangement.
Figure 2:
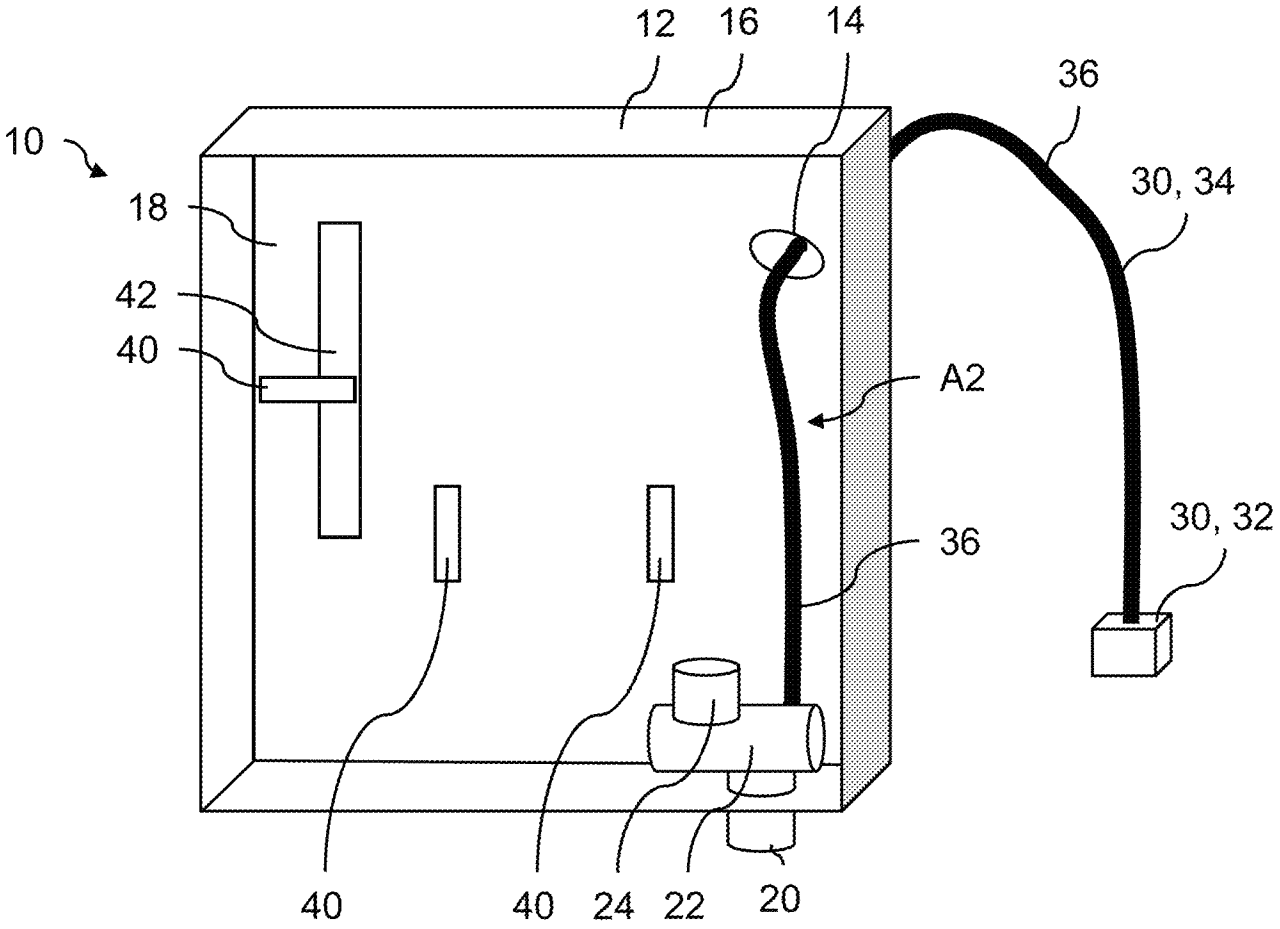
FIG. 2 is a schematic perspective view showing the diving apparatus from FIG. 1 with the display line in a second arrangement.
Figure 3:
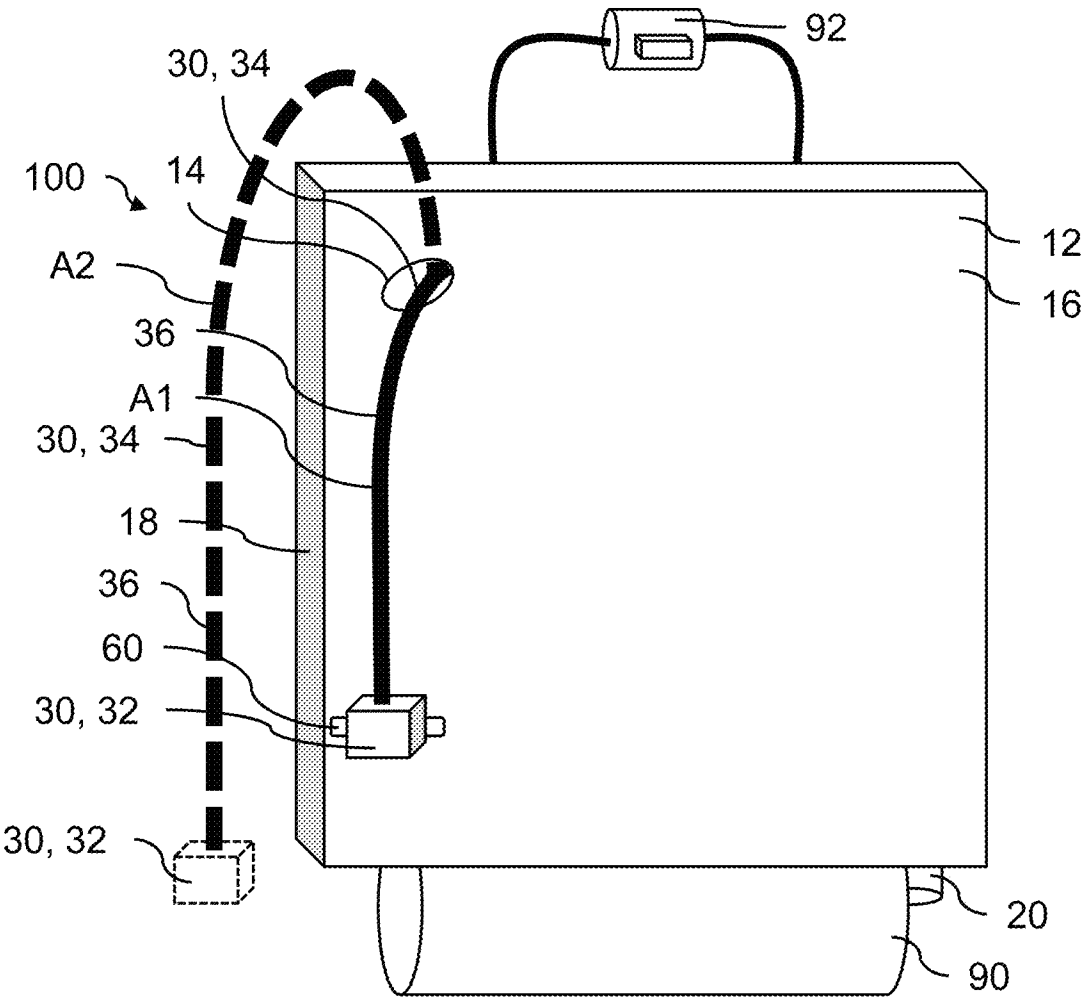
FIG. 3 is a schematic perspective view showing a diving system with the display line of the diving apparatus in a first arrangement and with a sketched second arrangement.

Referring to the drawings, elements with identical function and mode of operation are each provided with the same reference number in FIGS. 1 through 3.

An inner side 18 of a basic body 12 of a diving apparatus 10 with three holding elements 40 and with a display line 34 in a first arrangement A1 is shown in a perspective view in FIG. 1. The diving apparatus 10 according to the present invention has three holding elements 40, wherein two holding elements 40 are arranged parallel to one another and a third holding element 40 is arranged at an angle, here 90°, to the first two holding elements 40. The third holding element 40 is arranged at a holding element mount (counter-holding element) 42 and is, for example, mounted in a rotatable and/or displaceable manner at this holding element mount. The first two holding elements 40 are arranged and detachably fastened in a fixed and nonrotatable manner in a holding element mount 42 each. Another holding element mount 42 is not used in the arrangement A1 shown. The display line 34 of the display device 30 is detachably fastened in the three holding elements 40 and is thus arranged in a first arrangement A1 in the basic body 12 of the diving apparatus 10, which basic body 12 is configured as a housing. The display line 34 of the display device 30 is detachably fastened on the inner side 18 of the basic body in the holding elements 40. The display line 34 is guided through the opening 14 of the basic body 12 on the outer side 16 of the basic body 12. The display instrument 32 of the display device 30 is arranged at the free end of the display line 34 and is located on the outer side 16 of the basic body 12 of the diving apparatus 10. The diving apparatus 10 has, moreover, a pressure reducer 22, a tank interface 20 and a mouthpiece interface 24. The pressure reducer 22 is arranged in a gas path of the diving apparatus 10 between the tank interface 20 and the mouthpiece interface 24 for reducing a gas pressure of the breathing air. The basic body 12 further has a guide element 44 in the form of a guide groove for the guiding and/or fastening of the display line 34 at the basic body 12. The guide element 44 is configured monolithically with the basic body 12, especially with a basic body 12 configured as a housing. The display line 34 of the diving apparatus 10 according to the present invention thus has a free section 36 and a fastened section 38, wherein the fastened section 38 can be produced from a part of the free section 36 due to the detachable fastening of the display line 34 at the holding elements 40, wherein the three holding elements 40 are arranged in the basic body 12 such that the length of the free section 34 can be shortened and the fastened section 38 can be produced and/or lengthened due to the detachable fastening of the display line 34 at the holding elements 40. The first arrangement A1 being shown in FIG. 1 is configured for diving with the diving apparatus 10 according to the present invention in a chest-carrying method and the display line 34 of the display device 30 is advantageously fastened and reduced in length outside of the basic body 12 of the diving apparatus 10, so that hazardous situations, for example, an entanglement of the display line 34 are avoided and/or reduced.

The diving apparatus from FIG. 1, with the display line 34 in a second arrangement A2, is shown in a perspective view in FIG. 2. The display line 34 of the display device 30 is detached from the holding elements 40 and oriented in a second arrangement A2. Consequently, the display line 34 no longer has a fastened section 38 according to the present invention and the length of the free section 36 comprises the entire length of the display line 34, as a result of which the display line 34 protrudes farther from the basic body 12 of the diving apparatus 10, which basic body is configured as a housing, and the display instrument 32 is arranged at a spaced location from the basic body 12 of the diving apparatus 10. The arrangement A2 shown in FIG. 2 is configured for diving with the diving apparatus 10 according to the present invention in a back-carrying method. Of course, it is possible to reduce and/or to increase the length of the free section 36 and/or of the fastened section 38 in some sections between the shown arrangements A1 and A2 by the display line 34 being detachably fastened in one or more holding elements 40.

A diving system 100 with the display line 34 of the diving apparatus 10 in a first arrangement A1 and in a sketched second arrangement A2 is shown in a perspective view in FIG. 3. The diving system 100 is shown in comparison to FIGS. 1 and 2, as an example, from an opposite outer side 16 of the basic body 12 of the diving apparatus 10. The diving system 100 has a breathing air tank 90 and a mouthpiece 92. The display line 34 of the display device 30 is shown in a first arrangement A1 for diving with the diving apparatus 10 according to the present invention in a chest-carrying method. A second arrangement A2 is suggested in a sketched manner, wherein the second arrangement A2 is configured for diving with the diving apparatus 10 according to the present invention in a back-carrying method. The display instrument 32 of the display device 30 of the first arrangement A1 is stowed in a stowing bracket 60 on the outer side 16 of the basic body 12 of the diving apparatus 10. A display instrument 32 of the display device 30 of the second arrangement A2 is usually stowed in a carrying system of the diving system 100, which carrying system is not considered in more detail here.

While specific embodiments of the invention have been shown and described in detail to illustrate the application of the principles of the invention, it will be understood that the invention may be embodied otherwise without departing from such principles.

LIST OF REFERENCE CHARACTERS

10 Diving apparatus
12 Basic body
14 Opening of the basic body
16 Outer side of the basic body
18 Inner side of the basic body
20 Tank interface
22 Pressure reducer
24 Mouthpiece interface
30 Display device
32 Display instrument
34 Display line
36 Free section of the display line
38 Fastened section of the display line
40 Holding element
42 Holding element mount
44 Guide element
60 Stowing bracket
90 Breathing air tank
92 Mouthpiece
100 Diving system
A Arrangement of the display line

What is claimed is:

1. A diving apparatus for supplying breathing air, the diving apparatus comprising:

a basic body comprising a front side and a back side, the front side and the back side of the basic body defining at least a portion of a basic body interior space of the basic body, the basic body interior space being located between the front side and the back side;

a tank interface configured to connect to at least one breathing air tank for an inlet of breathing air from the breathing air tank into the diving apparatus;

a mouthpiece interface configured to connect to a mouthpiece for a supply of breathing air from the diving apparatus;

a pressure reducer arranged in a gas path of the diving apparatus between the tank interface and the mouthpiece interface for reducing a gas pressure of the breathing air;

a display device comprising a display instrument and a display line; and a holding element configured to detachably fasten the display line at the basic body, the holding element being arranged in the basic body interior space.

2. A diving apparatus in accordance with claim 1, wherein:

the holding element is located between the front side and the back side;

the basic body has an outer side and an inner side;

the inner side defines a portion of the basic body interior space; and the holding element is arranged on the inner side of the basic body.

3. A diving apparatus in accordance with claim 2, wherein the basic body comprises an opening for guiding through the display line from the inner side to the outer side, wherein the display instrument is arranged on the outer side, the holding element being arranged adjacent to an inner surface of the basic body, the inner surface defining a portion of the basic body interior space.

4. A diving apparatus in accordance with claim 1, further comprising a stowing bracket for stowing and detachably fastening of the at least one display instrument at the basic body.

5. A diving apparatus in accordance with claim 1, wherein the holding element is configured for a tool-free fastening and removal of the display line at the basic body.

6. A diving apparatus in accordance with claim 1, further comprising another holding element wherein the holding element and the other holding element are arranged at a spaced location and/or at an angle to one another.

7. A diving apparatus in accordance with claim 1, wherein the at least one display line is configured as a pressure measuring line and/or the at least one display instrument is configured as a manometer.

8. A diving apparatus in accordance with claim 1, wherein:

the display line has a free section and a fastened section formed from a part of the free section by the detachable fastening of the display line at the holding element; and the holding element is arranged at the basic body such that a length of the free section is shortenable and the fastened section can be produced and/or can be lengthened by the detachable fastening of the display line at the holding element.

9. A diving apparatus in accordance with claim 1, further comprising two holding element mounts, wherein the holding element is configured to be fastened to each of the holding element mounts.

10. A diving apparatus in accordance with claim 1, wherein the holding element is configured to cooperate with the display line to orient the display line at least in a first defined arrangement and in a second defined arrangement.

11. A diving apparatus in accordance with claim 1, wherein:

the display line comprises a counter-holding element; and the counter-holding element is configured for the detachable fastening with the holding element.

12. A diving apparatus in accordance with claim 1, wherein the basic body has at least one guide element comprising a raised section and/or one recess, for guiding the display line.

13. A diving system comprising:

a breathing air tank and/or a mouthpiece; and a diving apparatus for supplying breathing air, the diving apparatus comprising:

a basic body comprising a front side and a back side, the front side and the back side defining at least a portion of a basic body interior space of the basic body, the basic body interior space being located between the front side and the back side;

a tank interface configured to connect to the breathing air tank for an inlet of breathing air from the breathing air tank into the diving apparatus;

a mouthpiece interface configured to connect to the mouthpiece for a supply of breathing air from the diving apparatus;

a pressure reducer arranged in a gas path of the diving apparatus between the tank interface and the mouthpiece interface for reducing a gas pressure of the breathing air;

a display device comprising a display instrument and a display line; and a holding element configured to detachably fasten the display line at the basic body, the holding element being arranged in the basic body interior space.

14. A diving system in accordance with claim 13, wherein:

the holding element is located between the front side and the back side;

the basic body has an outer side and an inner side;

the inner side defines a portion of the basic body interior space; and the holding element is arranged on the inner side of the basic body.

15. A diving apparatus in accordance with claim 14, wherein the basic body comprises an opening for guiding through the display line from the inner side to the outer side, wherein the display instrument is arranged on the outer side, the holding element being arranged adjacent to an inner surface of the basic body, the inner surface defining a portion of the basic body interior space.

16. A diving system in accordance with claim 13, further comprising a stowing bracket for stowing and detachably fastening of the at least one display instrument at the basic body.

17. A diving system in accordance with claim 13, further comprising:

two holding element mounts; and another holding element, wherein the holding element and the other holding element are arranged at a spaced location and/or at an angle to one another and the holding element and the other holding element are configured to be fastened to each of the holding element mounts.

18. A diving system in accordance with claim 13, wherein the at least one display line is configured as a pressure measuring line and/or the at least one display instrument is configured as a manometer.

19. A diving system in accordance with claim 13, wherein:

the display line has a free section and a fastened section formed from a part of the free section by the detachable fastening of the display line at the holding element; and the holding element is arranged at the basic body such that a length of the free section is shortenable and the fastened section can be produced and/or can be lengthened by the detachable fastening of the display line at the holding element.

20. A diving system in accordance with claim 13, wherein:

the display line comprises a counter-holding element; and the counter-holding element is configured for the detachable fastening with the holding element.

21. A diving system in accordance with claim 13, wherein the basic body has at least one guide element comprising a raised section and/or one recess, for guiding the display line.

* * * * *